US006138919A

United States Patent [19]

Cooper et al.

[11] Patent Number: 6,138,919

[45] Date of Patent: Oct. 31, 2000

[54] MULTI-SECTION EVAPORATOR FOR USE IN HEAT PUMP

[75] Inventors: Kenneth W. Cooper, Seven Valleys; Martin A. Rawhouser, York, both of Pa.

[73] Assignee: Pool Fact, Inc., Hollywood, Calif.

[21] Appl. No.: 08/934,083

[22] Filed: Sep. 19, 1997

[51] Int. Cl.[7] ..... G05D 23/00; F25B 5/00

[52] U.S. Cl. ..... 237/2 B; 62/199; 62/238.6

[58] Field of Search ..... 62/199, 238.6, 62/238.7; 237/2 B; 165/299

[56] References Cited

U.S. PATENT DOCUMENTS

| | | | |
|---|---|---|---|
| 2,619,326 | 11/1952 | McLenegan | 62/238.6 |
| 3,677,028 | 7/1972 | Raymond | 62/200 |
| 4,009,592 | 3/1977 | Boerger | 62/222 |
| 4,165,037 | 8/1979 | McCarson | 62/238.6 X |
| 4,596,123 | 6/1986 | Cooperman | 62/199 |
| 4,658,596 | 4/1987 | Kuwahara | 62/197 |
| 4,685,309 | 8/1987 | Behr | 62/309 |
| 5,050,393 | 9/1991 | Bryant | 62/115 |
| 5,103,650 | 4/1992 | Jaster | 62/198 |
| 5,170,638 | 12/1992 | Koenig et al. | 62/204 |
| 5,205,133 | 4/1993 | Lackstrom | 62/238.4 |
| 5,431,026 | 7/1995 | Jaster | 62/221 |
| 5,447,038 | 9/1995 | Vaynberg | 62/175 |
| 5,560,216 | 10/1996 | Holmes | 62/161 |
| 5,582,236 | 12/1996 | Eike et al. | 163/43 |

OTHER PUBLICATIONS

Advertisement: Heat Perfector XXI–C, Mar. 1994.

*Primary Examiner*—William Wayner
*Attorney, Agent, or Firm*—Dorsey & Whitney LLP

[57] ABSTRACT

A multi-section evaporator is employed in a heat pump system which includes a compressor, a condenser and an evaporator. A control valve is connected between each adjacent set of evaporator sections and the control valve is operable in response to temperature and/or pressure conditions sensed by a sensor. In response to a sensed condition, one or more sections of the evaporator are brought into operation concurrently with the previously operating section (s). Thus, the effective size of the evaporator is variable depending on the sensed condition.

20 Claims, 2 Drawing Sheets

MULTI-SECTION EVAPORATOR FOR USE IN HEAT PUMP

BACKGROUND OF THE INVENTION

The invention relates to swimming pool heat pumps of the type used to heat the water in a swimming pool, and more particularly it relates to a multi-section evaporator, and a method of using the same.

1. Field of the Invention

The invention relates to the fields of heat pumps in general and swimming pool heaters in particular, especially the evaporator units employed in such heat pumps.

2. Description of Related Art

Swimming pool heat pumps are known in the prior art. Such heat pumps utilize ambient air to increase the amount of heat available to heat the pool water, spa water or hot tub water. They customarily do so by multiplying the energy put into the water heater from the electric power line several times, which makes the unit more cost effective to operate. Typically, this multiplication effect, called Coefficient of Performance (COP), will be 4 to 6, but only in ideal operating conditions.

Many known forms of swimming pool heat pumps are designed to operate most efficiently in warm humid weather, similar to the climate present in Florida and other southern coastal states, where there is a relatively narrow range between daily temperature highs and lows. Such heat pumps will not operate efficiently and may even be unreliable in desert climates, such as found in Arizona, where the temperature can range very widely, say from 30° F. to 115° F., and where the relative humidity remains in the low range from 15% to 30%. In such climates, the COP of known heat pumps can fall dramatically at the low temperature low humidity conditions, and at the high temperature conditions the heat pump may break or fail.

The key component of such heat pumps is the evaporator. Heat pump evaporators are very sensitive to the amount of moisture in the air which pass over them. Devices that are designed to operate in humid climates, like Florida, contain evaporators optimized for such humid conditions. A heat pump containing this form of evaporator will not be as efficient, and may not even operate, at the lower outdoor temperatures, and in low humidity conditions, like those found in Arizona. As a result, a heat pump containing such an evaporator might not even work to heat the swimming pool water in such conditions.

SUMMARY OF THE INVENTION

The present invention overcomes the problems associated with such known forms of swimming pool heat pumps by providing an improved and novel form of multi-section evaporator. The evaporator is split into two or more sections, each controlled by its own expansion device. The first section is sized such that operational efficiency and reliability are maintained during the high temperature and dry daytime conditions which occur from May through September in desert climates. The evaporator also contains a second section which operates in response to a sensed condition, such as the presence of lower or cooler temperatures, like those present in the desert climate during the spring and fall seasons, as well as in the nighttime of the summer season. When the second section of the evaporator is working in conjunction with the first section, the evaporator becomes larger in size and thus more efficient at providing heat during the cool dry conditions.

Additional evaporator sections may be provided for to meet the loading requirements of special climactic conditions, with each section working in conjunction with the others to achieve efficient and reliable operation of the heat pump.

DESCRIPTION OF THE PREFERRED EMBODIMENT(S)

Figure 1:
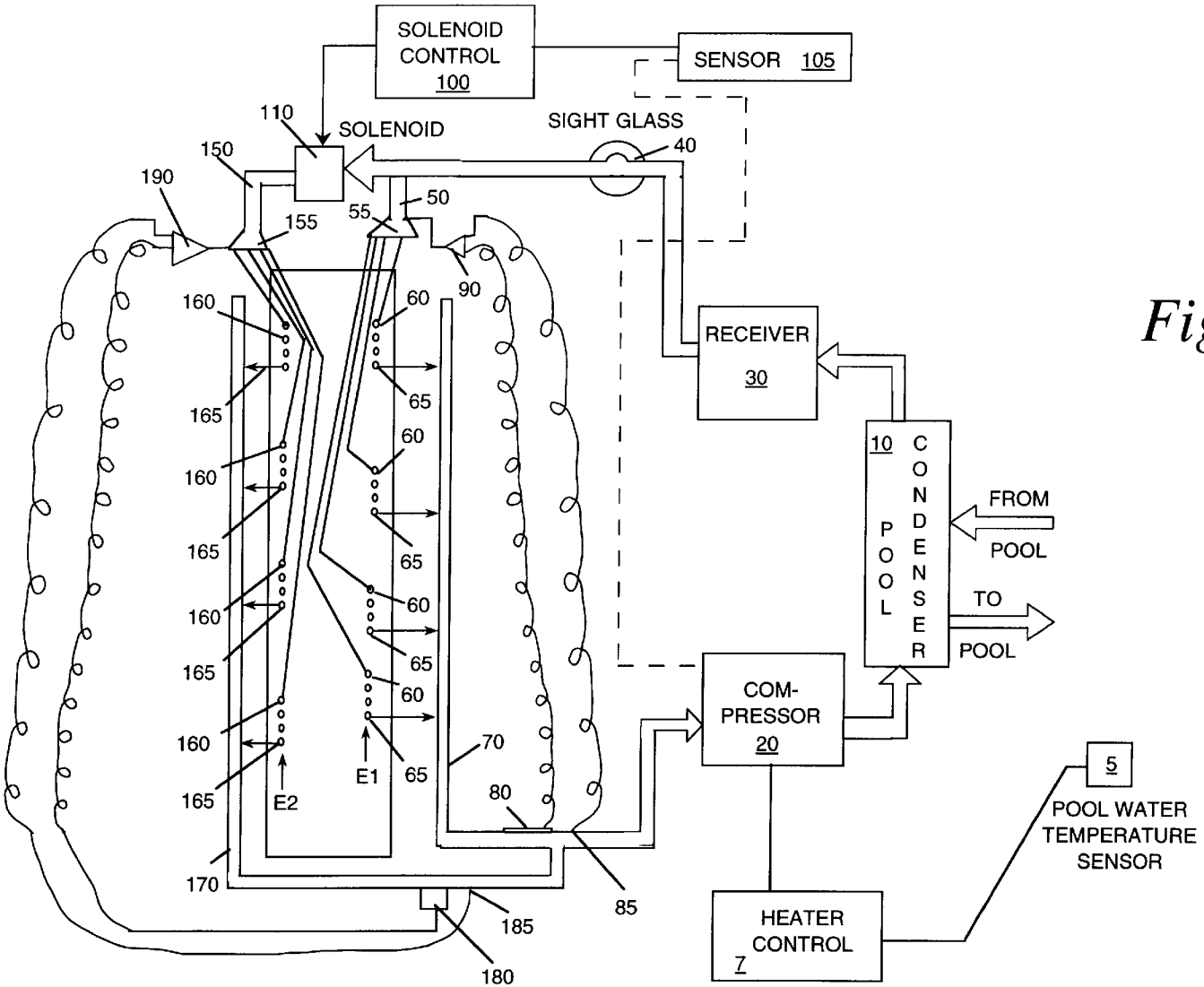
FIG. 1 is a block diagram of a first embodiment of the invention, showing a two-section evaporator.

FIG. 1 shows a first embodiment of the invention, in which a swimming pool heating pump system utilizes a two-stage evaporator. The system is connected to a body of water, not shown, such as a swimming pool, spa, or the like.

The water temperature is sensed by pool water temperature sensor 5, which is connected to a heater control circuit 7, which activates a compressor 20 if the pool water is below a predetermined temperature. The predetermined temperature used by the heater control circuit 7 may be preset or may be adjusted by the pool owner. The heater control circuit 7 operates, as is known in the art, by cycling on the compressor 20 until the pool water reaches a temperature slightly in excess of the predetermined temperature, as sensed by the pool water temperature sensor 5. The compressor 20 is then shut off until the pool water temperature sensor 5 indicates that the temperature of the pool water has fallen below the predetermined temperature. The heater control circuit 7 may contain a microprocessor as known in the art.

In a normal heating cycle, pool water flows into pool condenser 10. The pool water is heated in the pool condenser 10 and recirculates back into the pool. The water heating is created through the use of a refrigerant fluid which enters the inlet of the compressor 20 as a gas and is compressed therein to a high pressure with a resulting high temperature. The compressor is operated electrically. The heated and pressurized gas from the compressor 20 flows into a pool condenser 10 wherein it gives up its heat to the pool water, thereby increasing the temperature of the water. During this process the refrigerant changes from a gaseous to a high pressure liquid state. The liquid refrigerant then flows to a receiver 30, past an optional sight glass 40 which is used to visually assess the level of liquid, and then on to the evaporator, which is generally designated E.

A first expansion device 50 is interposed between the receiver 30 and the evaporator, downstream from the sight glass 40. The expansion device 50 changes the high pressure high temperature liquid state refrigerant to a low pressure low temperature liquid state. The expansion device 50 has an associated controller 90, connected by a temperature sensor 80 and a pressure sensor 85 to a return line 70 which connects the first section of the evaporator back to the inlet of the compressor 20. The operation of such an expansion device is well known in the art and forms no part of the present invention.

The first expansion device 50 controls the flow of the refrigerant into the first evaporator section El wherein heat obtained from the ambient air will cause the liquid refrigerant to be converted into gaseous form. A first distributor 55 is used to channel the low pressure low temperature working fluid into the parallel circuits of evaporator section E1. The evaporator contains elements which divide the same into parallel circuits to control the working fluid pressure drop within the evaporator and obtain optimum heat absorption efficiency. In the embodiment depicted in FIG. 1, the evaporator section E1 is preferably a finned-tube coil type evaporator wherein the refrigerant enters the coil through a number of inlets 60 and exits coil through a number of outlets 65.

The evaporator section E1 is exposed to (i.e., in thermal contact with) the outside air and allow the refrigerant to gather heat from the outside air and thereby vaporize from its liquid form. The vaporized refrigerant then passes through a return line 70 to the inlet of the compressor 20. The system thus far described is a somewhat standard and known prior art form of swimming pool heat pump system.

However, since expansion devices can only operate effectively under a certain range of temperature/pressure conditions, it has been found that when the outside temperature is extremely low, or the outside air becomes very dry, the first evaporator section E1 functions inefficiently if it is used alone. Therefore in accordance with the present invention, additional evaporator sections are provided, together with control means for determining when they will be brought into operation.

In FIG. 1, a second evaporator section E2 is shown. The second section E2 is brought into operation by a solenoid control circuit 100, which serves as a valve control unit and which opens a solenoid valve 110 when certain ambient conditions are sensed. The solenoid control circuit 100 is connected and responsive to a sensor 105. The sensor measures certain conditions, as, for example, the outdoor temperature in the area of the evaporator coil E of the heat pump unit. When the sensor 105 senses that the outdoor temperature has fallen below a predetermined or preset value, it transmits a signal which causes the solenoid control circuit 100 to open the solenoid 110 to place the second evaporator section E2 into use. Alternatively, the sensor 105 may be used to sense the suction pressure at the inlet of the compressor 20. When the suction pressure falls below a predetermined or preset value, the sensor transmits a signal to the solenoid control circuit 100 to open the solenoid valve 110. As a third alternative, the sensor 105 may be used to sense the temperature of the evaporator section E1, and, if that temperature is below a predetermined or preset value, it will send a signal to the solenoid control circuit 100 to open the solenoid valve 110. While the solenoid control circuit 100 may contain a microprocessor or other computer logic, the details of such a circuit do not form any part of the present invention.

Once the control circuit 100 causes the solenoid valve 110 to open, a second expansion device 150 controls the flow of the refrigerant into the second evaporator section E2 wherein heat obtained from the ambient air will cause the liquid refrigerant to be converted into gaseous form. A second distributor 155 is used to channel the low pressure low temperature working fluid into the parallel circuits of evaporator section E2. The evaporator contains elements which divide the same into parallel circuits to control the working fluid pressure drop within the evaporator and obtain optimum heat absorption efficiency. In the embodiment depicted in FIG. 1, the evaporator section E2, like the section E1, is preferably a finned-tube coil type evaporator wherein the refrigerant enters the coil through a number of inlets 160 and exits coil through a number of outlets 165.

A second distributor 155 is used to direct the refrigerant liquid from the second expansion device 150 into the second evaporator section E2. This evaporator section is exposed to (i.e., in thermal contact with) the outside air and allow the refrigerant to gather heat from the outside air and thereby vaporize from its liquid form into a gaseous form. The vaporized refrigerant then passes through a return line 170 to the inlet of the compressor 20. The second expansion device 150 has an associated controller 190 connected by a temperature sensor 180 and a pressure sensor 185 to the return line 170.

When the second evaporator section E2 is brought into operation, it works in combination with the first evaporator section E1. That is, vaporized refrigerant from the first section E1 is transmitted through the return line 70, and the vaporized refrigerant from the second section E2 is transmitted from the second section E2 through the return line 170, and both return lines direct such refrigerant to the inlet to the compressor 20.

The second evaporator section E2 may be of a different size than the first evaporator section E1.

Thus, under low temperature conditions, both evaporator sections E1 and E2 are used. Receiver 30 provides the additional refrigerant necessary to function when evaporator section E2 is in use. When the condition sensed by the sensor 105 is no longer present, the solenoid control circuit 100 closes the solenoid valve 110 and the excess refrigerant is stored in the receiver 30.

It is not necessary that the second expansion device 150 and the second distributor 155 have the same capacity as the first expansion device 50 and the first distributor 55. In one preferred embodiment, the ratio of the relative sizes between the expansion device 50/distributor 55 and expansion device 150/distributor 155 is 5:4. In this preferred embodiment, the solenoid control circuit 100 is set to open the solenoid valve 110 upon occurrence of a sensed outside temperature of 83 degrees Fahrenheit when the temperature is falling. The solenoid control circuit 100 will close the solenoid valve 110 at an outside temperature of 88 degrees Fahrenheit when the temperature is rising. The solenoid valve 110 and expansion devices 90 and 190 are made by Sporlan Valve Company of 206 Lange Drive, Washington, Mo. (USA). The compressor 20 is a scroll type compressor made by Copeland Corporation of 1675 W. Campbell Rd., Sidney, Ohio (USA). The other components are typical of those known and available in the art.

Figure 2:
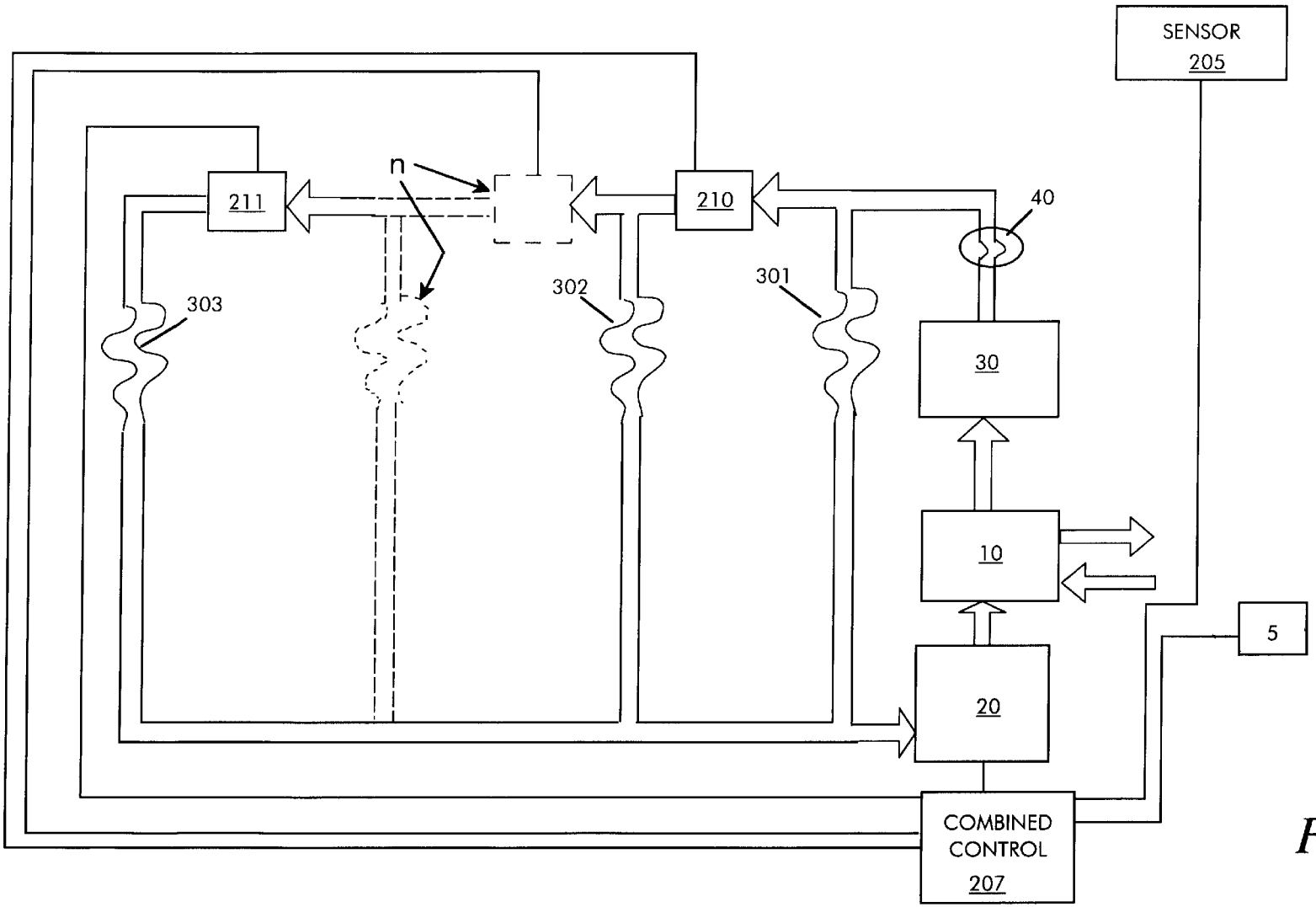
FIG. 2 is a block diagram of a second embodiment of the invention, showing a multi-section evaporator.

FIG. 2 shows another preferred embodiment, where three or more evaporators sections may be used. Although not shown, each evaporator in this embodiment utilizes an associated expansion device. As shown in FIG. 2, the system uses a pool water temperature sensor 5, a compressor 20, a condenser 10, and a receiver 30, and a sight glass 40, all as described with respect to FIG. 1. In this embodiment, the evaporator sections 301, 302, 303 are present, along with a number of solenoids valves 210, 211. Additionally, any number ("n") additional solenoids valves, expansion devices, and evaporator sections (shown in dashed lines in FIG. 2) may be included. The solenoid valves 210, 211 (and any additional "n" solenoid valves) are connected to a combined control circuit 207. The combined control circuit 207 of FIG. 2 combines the functionality of the solenoid control circuit 100 (FIG. 1) and the heater control circuit 7 (FIG. 1). Thus, in the FIG. 2 embodiment, the combined control circuit 207 receives signals corresponding to ambient conditions from the sensor 205 and the pool water temperature from the pool water temperature sensor 5.

The FIG. 2 embodiment works in the same way as the FIG. 1 embodiment, but contains more evaporator sections and solenoid valves. In operation, the refrigerant is compressed by compressor 20, gives up its heat in pool condenser 10, and flows to receiver 30, just as in the FIG. 1 embodiment. However, the effective size of the evaporator is increased by the number of solenoid valves in the open condition, which determines the number of evaporator sections in operation at any given time. The solenoid valves are opened in sequence, i.e. first valve 210 is opened, then the next "n" valve is opened, and the next (and so on for "n" solenoid valves), until the last solenoid valve 211 is opened. The effective size of the evaporator increases with each opened valve to adapt the evaporator for any number of environmental conditions.

The heating control of FIG. 2 is performed by the combined control circuit 207, which is connected to the pool water temperature sensor 5 to control the on/off cycle of the heat pump by supplying power to the compressor 20 in response to the sensed temperature of the pool water. The combined control circuit 207 may contain a processor to control the solenoid valves 210, 211 (and any additional "n" solenoid valves) and the compressor 20.

By virtue of the present invention, it is unnecessary for a swimming pool heater pump system to utilize two or more compressors or two or more separate refrigerant circuits. The same refrigerant flows through each evaporator and through a single condenser and compressor. It has been found that the COP for range for typical embodiments of this invention is generally about 5, although closer to 6 in high temperature conditions and closer to 4 in low temperature conditions, where a heat pump of the prior art would fail or be extremely inefficient).

The foregoing description of the present invention has been presented for purposes of illustration and description which is not intended to limit the invention to the specific embodiments described. Consequently, variations and modifications commensurate with the above teachings, and within the skill and knowledge of the relevant art, are part of the scope of the present invention. It is intended that the appended claims be construed to include alternative embodiments to the extent permitted by law.

What is claimed is:

1. In a heat pump system for a swimming pool or other body of water, said heat pump system being the type which includes a compressor operable responsively to water temperature sensing means, a condenser for receiving water to be heated and returning it in heated state, an evaporator connected with the compressor, and a refrigerant fluid contained in a closed circuit between said compressor, condenser and evaporator, the improvement which comprises:

said evaporator containing at least a first section and a second section;

each of said sections containing elements in the form of a coil capable of converting said fluid from a liquid to a gaseous state;

each of said sections having more than one inlet;

each of said sections having a return line connected to said compressor for returning the refrigerant in gaseous state to the compressor;

a control valve connected between said first and second sections;

a sensor operably connected with a valve control unit;

said valve control unit being operably connected with said control valve to open or close said control valve in response to sensed ambient conditions;

said valve control unit maintaining said control valve in its closed position in response to a first ambient condition in which a lesser amount of heat is desired from the ambient air, in which event only said first evaporator section is utilized to convert said refrigerant to its gaseous state and deliver it through the first section return line to said compressor;

said valve control unit opening said control valve in response to a second ambient condition in which a greater amount of heat is desired from the ambient air, in which event both said first and said second evaporator sections are utilized to convert said refrigerant to its gaseous state, and said refrigerant is delivered through both said first and said second section return lines to said compressor;

wherein said second ambient condition is a low temperature condition.

2. The improvement defined in claim 1 wherein the sensed ambient condition is temperature of the air surrounding the water.

3. The improvement defined in claim 2 having successive outlets.

4. The improvement defined in claim 3 wherein said inlets are connected to the section through a distributor and the outlets are connected to the return line.

5. The improvement defined in one of claims 1 or 2 further including a receiver interposed between said compressor and said evaporator for receiving said refrigerant fluid from the condenser in liquid form.

6. The improvement defined in one of claims 1 or 2 further including an expansion device associated with each of said evaporator sections.

7. The improvement defined in claim 6 wherein each expansion device is connected to its associated return line by a temperature and pressure sensing means.

8. The improvement defined in claim 1 in which the sensed ambient condition is pressure of the refrigerant.

9. The improvement defined in claim 1 wherein the number of evaporator sections is n and the number of control valves is n-1, wherein n is an integer of 3 or more.

10. The improvement defined in claim 1 wherein each evaporator section is a different size.

11. An apparatus for heating a pool, the apparatus comprising:

a sensor;

a heater control circuit connected to said sensor;

a compressor connected to said heater control circuit, whereby said heater control circuit activates said compressor when a temperature of pool water has fallen below a predetermined temperature;

a condenser connected to said compressor, whereby said water in said pool is heated;

a receiver connected to said condenser, whereby said refrigerant is received;

a first expansion device connected to said receiver, whereby said flow of said refrigerant is controlled;

a first distributor connected to said first expansion device, whereby said refrigerant is channeled;

a first evaporator having at least one coil and having more than one inlet connected between said first distributor device and said compressor;

at least one additional evaporator;

at least one valve connected between said receiver and said at least one additional evaporator, whereby said refrigerant flows into said at least one additional evaporator;

at least one valve control unit, whereby said at least one valve is opened when a certain condition is sensed;

at least one sensor connected to said at least one valve control, whereby said certain condition is sensed, wherein said certain condition is a low temperature condition;

at least one additional expansion device connected to said at least one valve, whereby said flow of said refrigerant is controled; and at least one additional distributor connected to said at least one additional expansion device, whereby said refrigerant is channeled.

12. The apparatus according to claim 11, wherein said at least one valve is a solenoid valve.

13. The apparatus according to claim 11, wherein said at least one sensor is a temperature sensor for sensing water temperature.

14. The apparatus according to claim 11, wherein said at least one sensor is a temperature sensor for sensing a temperature of said first evaporator.

15. The apparatus according to claim 11, wherein said first evaporator and said at least one additional evaporator are finned-tube coil type evaporators.

16. A method for heating a pool, the method comprising:

compressing refrigerant;

condensing said refrigerant from a gaseous to a high pressure liquid state;

receiving said refrigerant;

expanding said refrigerant from said high pressure liquid state to a low pressure low temperature liquid state;

channeling said refrigerant through more than one inlet into at least one evaporator having at least one coil;

heating said refrigerant from outside air in one of said at least one evaporator;

sensing a low temperature condition;

expanding additional refrigerant from said high pressure liquid state to said low pressure low temperature liquid state in response to said sensed low temperature condition;

channeling said additional refrigerant into at least one other of said at least one evaporator; and heating said additional refrigerant from outside air in said at least one other evaporator in response to said sensed low temperature condition.

17. The method according to claim 16, further comprising the step of removing said additional refrigerant from said at least one other evaporator when said certain condition is no longer present.

18. The method according to claim 16, wherein said step of sensing said certain condition further comprises sensing water temperature.

19. The method according to claim 16, wherein said step of sensing said certain condition further comprises sensing suction pressure.

20. The method according to claim 16, wherein said step of sensing said certain condition further comprises sensing a temperature of one of said at least one evaporator.

* * * * *

UNITED STATES PATENT AND TRADEMARK OFFICE

CERTIFICATE OF CORRECTION

PATENT NO. : 6,318,919 
DATED : October 31, 2000
INVENTOR(S) : Kenneth W. Cooper and Martin A. Rawhouser It is certified that error appears in the above-identified patent and that said Letters Patent is hereby corrected as shown below:

Title page,
Item [73], Assignee, reads "Pool Fact, Inc., Hollywood, Calif." should read
-- Pool Fact, Inc., Hollywood, Florida --

Signed and Sealed this

Twenty-fifth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,138,919 
DATED : October 31, 2000
INVENTOR(S) : Kenneth W. Cooper and Martin A. Rawhouser It is certified that error appears in the above-identified patent and that said Letters Patent is hereby corrected as shown below:

Title page,
Item [73], Assignee, reads "Pool Fact, Inc., Hollywood, Calif." should read
-- Pool Fact, Inc., Hollywood, Florida --

Signed and Sealed this

Twenty-fifth Day of June, 2002

*Attest:*

*Attesting Officer*

JAMES E. ROGAN
*Director of the United States Patent and Trademark Office*